US008801286B2

(12) United States Patent
Tatsuno

(10) Patent No.: US 8,801,286 B2
(45) Date of Patent: Aug. 12, 2014

(54) STORAGE BAG

(75) Inventor: Isamu Tatsuno, Osaka (JP)

(73) Assignee: Mont-Bell Co., Ltd., Osaka-Shi, Osaka (JP)

( * ) Notice: Subject to any disclaimer, the term of this patent is extended or adjusted under 35 U.S.C. 154(b) by 526 days.

(21) Appl. No.: 12/371,093

(22) Filed: Feb. 13, 2009

(65) Prior Publication Data

US 2010/0002962 A1 Jan. 7, 2010

(30) Foreign Application Priority Data

Jul. 4, 2008 (JP) ..... 2008-176102

(51) Int. Cl.
*B65D 30/02* (2006.01)
*B65D 33/28* (2006.01)

(52) U.S. Cl.
USPC ..... 383/117; 383/41; 383/61.4

(58) Field of Classification Search
CPC ..... B65D 33/28; B32B 23/10; B31B 19/36; A45C 35/00; A45C 3/00; D06F 95/06
USPC ..... 383/41, 61.4, 67, 102, 103, 117
See application file for complete search history.

(56) References Cited

U.S. PATENT DOCUMENTS 2,080,252 A * 5/1937 Cook et al. ..... 383/90
2,132,734 A * 10/1938 Hart et al. ..... 383/102
2,522,604 A * 9/1950 Courter ..... 135/34.2
4,120,335 A * 10/1978 Mitchell ..... 383/7
4,174,739 A * 11/1979 Rasero et al. ..... 139/388
4,207,937 A * 6/1980 Sandeman et al. ..... 383/17
4,234,022 A * 11/1980 Okamoto et al. ..... 139/420 R
4,301,848 A * 11/1981 Beaven et al. ..... 383/20
4,325,999 A * 4/1982 Campman et al. ..... 428/112
4,357,714 A * 11/1982 Ito ..... 2/97
4,362,199 A * 12/1982 Futerman ..... 383/17
4,388,739 A * 6/1983 Martinon et al. ..... 383/102
4,421,805 A * 12/1983 Prader ..... 428/35.2
4,431,316 A * 2/1984 Massey ..... 383/113
4,556,440 A * 12/1985 Krueger ..... 156/181
4,573,204 A * 2/1986 Polett ..... 383/41
4,670,326 A * 6/1987 Heiman ..... 442/214
4,677,831 A * 7/1987 Wunner ..... 66/84 A (Continued)

FOREIGN PATENT DOCUMENTS

JP 53-154130 12/1978
JP 59-083475 6/1984

(Continued)

*Primary Examiner* — Hemant M Desai
*Assistant Examiner* — Gloria R Weeks
(74) *Attorney, Agent, or Firm* — Sterne, Kessler, Goldstein & Fox P.L.L.C.

(57) ABSTRACT

A storage bag that can maintain compactness, into which an object can be easily inserted and stored, and whose shape can be changed after the object is stored in the storage bag. A storage bag including a cylindrical body and a bottom at one end of the body, wherein the bottom closes one end of the body, the other open end of the body is formed as a storage opening, and the inside space of the storage bag is formed as a storage space capable of storing an object, and wherein the body is made of fabric in which fibers are woven in perpendicular directions, and the fiber directions A and B in the fabric are inclined with respect to the circumferential direction and the lengthwise direction of the body.

6 Claims, 7 Drawing Sheets

(56) References Cited

U.S. PATENT DOCUMENTS

| | | | | | |
|---|---|---|---|---|---|
| 4,763,369 | A * | 8/1988 | Spector | 5/640 |
| 5,118,201 | A * | 6/1992 | Cook | 383/12 |
| 5,158,220 | A * | 10/1992 | Glass | 224/657 |
| 5,232,118 | A * | 8/1993 | Samuel | 220/495.11 |
| 5,232,429 | A * | 8/1993 | Cizek et al. | 493/299 |
| 5,323,802 | A * | 6/1994 | Kiedrowski | 135/34.2 |
| 5,340,217 | A * | 8/1994 | Rothman | 383/17 |
| 5,451,108 | A * | 9/1995 | Anderson | 383/38 |
| 5,464,246 | A * | 11/1995 | Castro et al. | 280/730.2 |
| 5,679,449 | A * | 10/1997 | Ebadat et al. | 442/110 |
| 5,865,540 | A * | 2/1999 | Derby et al. | 383/24 |
| 5,884,454 | A * | 3/1999 | Steinmetz | 53/459 |
| 5,938,338 | A * | 8/1999 | McDonough | 383/24 |
| 5,945,356 | A * | 8/1999 | Pott | 442/57 |
| D414,686 | S * | 10/1999 | Simpson et al. | D9/617 |
| 6,004,891 | A * | 12/1999 | Tuppin et al. | 442/208 |
| 6,029,847 | A * | 2/2000 | Mahoney et al. | 220/739 |
| 6,085,695 | A * | 7/2000 | Miller et al. | 119/795 |
| 6,086,253 | A * | 7/2000 | Hartsfield | 383/22 |
| 6,112,772 | A * | 9/2000 | Ebadat et al. | 139/1 R |
| 6,142,192 | A * | 11/2000 | Dickinson et al. | 141/97 |
| 6,302,583 | B1 * | 10/2001 | Steinmetz | 383/33 |
| 6,371,645 | B1 * | 4/2002 | Rusert et al. | 383/107 |
| 6,821,600 | B1 * | 11/2004 | Henson | 428/99 |
| 7,125,168 | B2 * | 10/2006 | La Fleur et al. | 383/111 |
| 7,344,308 | B2 * | 3/2008 | Meyer et al. | 383/41 |
| 7,459,205 | B2 * | 12/2008 | Philp et al. | 428/222 |
| 7,827,829 | B2 * | 11/2010 | Fujikawa | 66/195 |
| 7,891,914 | B2 * | 2/2011 | Smallwood et al. | 405/302.6 |
| 7,922,421 | B2 * | 4/2011 | McGillick et al. | 405/16 |
| 7,988,681 | B2 * | 8/2011 | McGarity et al. | 604/317 |
| 8,037,583 | B2 * | 10/2011 | Davis | 26/51 |
| 2003/0044491 | A1 * | 3/2003 | Monforton et al. | 426/107 |
| 2005/0129337 | A1 * | 6/2005 | Sabounjian | 383/117 |
| 2005/0205456 | A1 * | 9/2005 | Meyer et al. | 206/525 |
| 2005/0249439 | A1 * | 11/2005 | Penson | 383/38 |
| 2007/0066171 | A1 * | 3/2007 | Bystricky et al. | 442/186 |
| 2008/0170813 | A1 * | 7/2008 | Sprosty | 383/107 |
| 2008/0267540 | A1 * | 10/2008 | Ashworth | 383/81 |
| 2008/0292223 | A1 * | 11/2008 | Bannister | 383/114 |
| 2009/0097780 | A1 * | 4/2009 | Chapman et al. | 383/33 |
| 2009/0180717 | A1 * | 7/2009 | Ferrer | 383/117 |
| 2011/0085749 | A1 * | 4/2011 | Frei et al. | 383/117 |

FOREIGN PATENT DOCUMENTS

| | | |
|---|---|---|
| JP | U3039646 | 5/1997 |
| JP | 2001-172809 A | 6/2001 |
| JP | 2002-179083 | 6/2002 |
| JP | 2003-143994 A | 5/2003 |
| JP | 2004-123141 A | 4/2004 |

* cited by examiner

STORAGE BAG

CROSS-REFERENCES TO RELATED APPLICATIONS

This application relates to and claims priority from Japanese Patent Application No. 2008-176102, filed on Jul. 4, 2008, the entire disclosure of which is incorporated herein by reference.

BACKGROUND

1. Field of the Invention

The present invention relates to a storage bag or storage container for storing an object such as a sleeping bag or a down jacket.

2. Description of Related Art

A cylindrical body with a bottom made of fabric is used as a storage bag for storing an object such as a sleeping bag or a down jacket. The object (sleeping bag or down jacket) is inserted into and stored in this kind of storage bag by being rolled-up and pushed into the storage bag through the storage bag's opening (see Japanese Patent Application Laid-Open (Kokai) Publication No. 2002-179083).

However, the size of the storage bag is made to be as small as possible in order to realize a compact size when an object is stored in the storage bag. As a result, considerable force is required to compress and roll up a normally voluminous object, such as a bulky sleeping bag or down jacket, in order to insert it into the storage bag. Therefore, it is burdensome, particularly for a user who does not have much strength, to do so.

SUMMARY

The present invention was devised in light of the circumstances described above. It is an object of the invention to provide a storage bag that can maintain compactness, into which an object can be easily inserted and stored, and whose shape can be changed after the object is stored in the storage bag.

In order to achieve the above-described object, provided according to an aspect of the present invention is a storage bag including a cylindrical body and a bottom at one end of the body, wherein the bottom closes one end of the body, the other open end of the body is formed as a storage opening, and the inside space of the storage bag is formed as a storage space capable of storing an object, and wherein the body is made of fabric in which fibers are woven in perpendicular directions, and the fabric fiber directions are inclined with respect to the circumferential direction and the lengthwise direction of the body.

Also, a storage container according to another aspect of the invention is a storage container (such as a bag or a backpack) that includes a body with its inside space serving as a storage space, wherein the storage container is capable of storing an object by inserting the object into the storage space through a storage opening formed at an open end of the body, wherein the body is made of fabric in which fibers are woven in perpendicular directions, and the fabric fiber directions are inclined with respect to the direction in which the object is inserted into the body (for example, a direction from the storage opening side toward the bottom of the storage container), as well as the direction perpendicular to the object insertion direction.

In the above-described configuration, the fiber directions of the fabric in which fibers are woven in perpendicular directions are inclined with respect to the circumferential direction of the body (the direction perpendicular to the object insertion direction) and the lengthwise direction (the object insertion direction). Accordingly, the body can stretch or contract in the circumferential direction (the direction perpendicular to the object insertion direction) and the lengthwise direction (the object insertion direction). As a result, when an object is to be stored in the storage space, the body can stretch in both its longitudinal and transverse directions, so that it is unnecessary to have a large body and the object can be smoothly inserted into and stored in the storage space. After the object is stored in the storage bag, the body, which has stretched in the circumferential direction (the direction perpendicular to the object insertion direction), contracts due to the restoring force (elasticity) of the fabric. As a result, it is possible to keep the size of the storage bag compact and make it easier to insert an object into and store it in the storage bag.

Particularly, when a normally voluminous and bulky object like a sleeping bag or a down jacket is to be stored in the storage bag, even if it is difficult to compress the object to the minimum size, the object can be easily inserted into and stored in the storage bag as long as the object is compressed to a certain extent; and it is possible to minimize the burden on the user as much as possible when compressing the object to insert it into the storage bag. Since the body can stretch or contract in its radial direction (transverse direction) or in its lengthwise direction (longitudinal direction) even while storing an object inside, when the storage bag is to be put into another bag or backpack, the storage bag can be inserted into the bag or backpack by changing the shape of the storage bag in accordance with dead space in the bag or backpack.

Moreover, the diameter of the body on the storage opening side may be larger than that on the bottom side. Because of this configuration, an object can be easily inserted into the storage bag through the storage opening with the large diameter. As a result, it is possible to make it much easier to insert an object into and store it in the storage bag.

Furthermore, the diameter of the body gradually may become larger from the bottom toward the storage opening. When pushing an object into the storage space, the above-described configuration enables smooth introduction of the object into the storage space, thereby making it much easier to insert the object into and store it in the storage bag.

A first tunnel-like loop extending along the circumference of the storage opening, and a first draw-string that is put through the first tunnel-like loop may be provided around the storage opening; and the storage opening may be narrowed and closed by pulling the first draw-string protruding from a first opening made at section of the tunnel-like loop. Because of this configuration, the storage opening can be easily narrowed and closed by pulling the first draw-string while the object is stored in the storage space.

Furthermore, a second tunnel-like loop extending along the circumference of the body and a second draw-string that is put through the second tunnel-like loop may be provided at a second narrowing position spaced apart from the storage opening towards the bottom side; and the body at the second narrowing position may be narrowed by pulling the second draw-string protruding from a second opening made at section of the second tunnel-like loop. Because of this configuration, the storage opening can be closed more tightly by narrowing the body at the second narrowing position spaced apart from the storage opening towards the bottom side, in addition to the narrowing position at the storage opening, by pulling the second draw-string while storing an object in the storage space with the storage opening in the narrowed and closed state.

According to the invention, the size of the storage bag can be kept compact, and an object can be easily inserted into and stored in the storage bag.

DETAILED DESCRIPTION OF PREFERRED EMBODIMENTS

Next, a storage bag according to an embodiment of the present invention will be explained. The embodiment described below is for the purpose of describing this invention, but the invention is not limited only to this embodiment. Accordingly, this invention can be utilized in various ways unless the utilizations depart from the gist of the invention.

Figure 1:
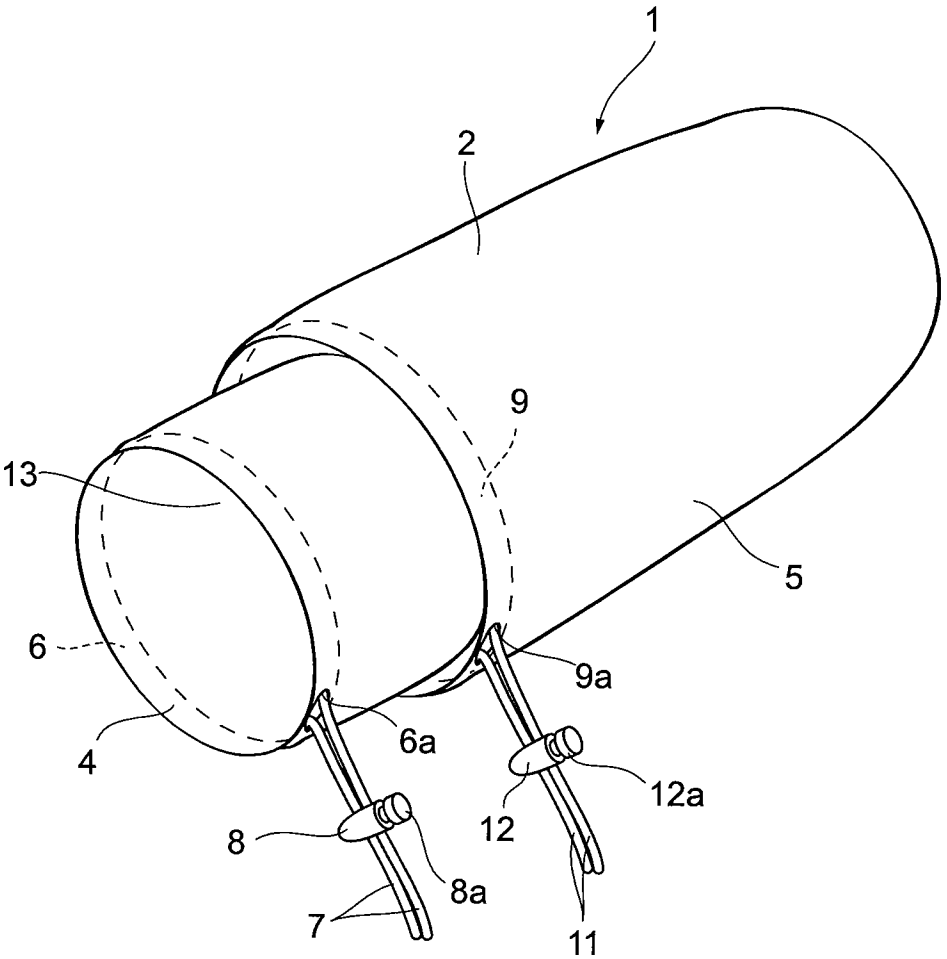
FIG. 1 is a perspective view of a storage bag according to an embodiment of the present invention as seen from its storage opening side.
Figure 2:
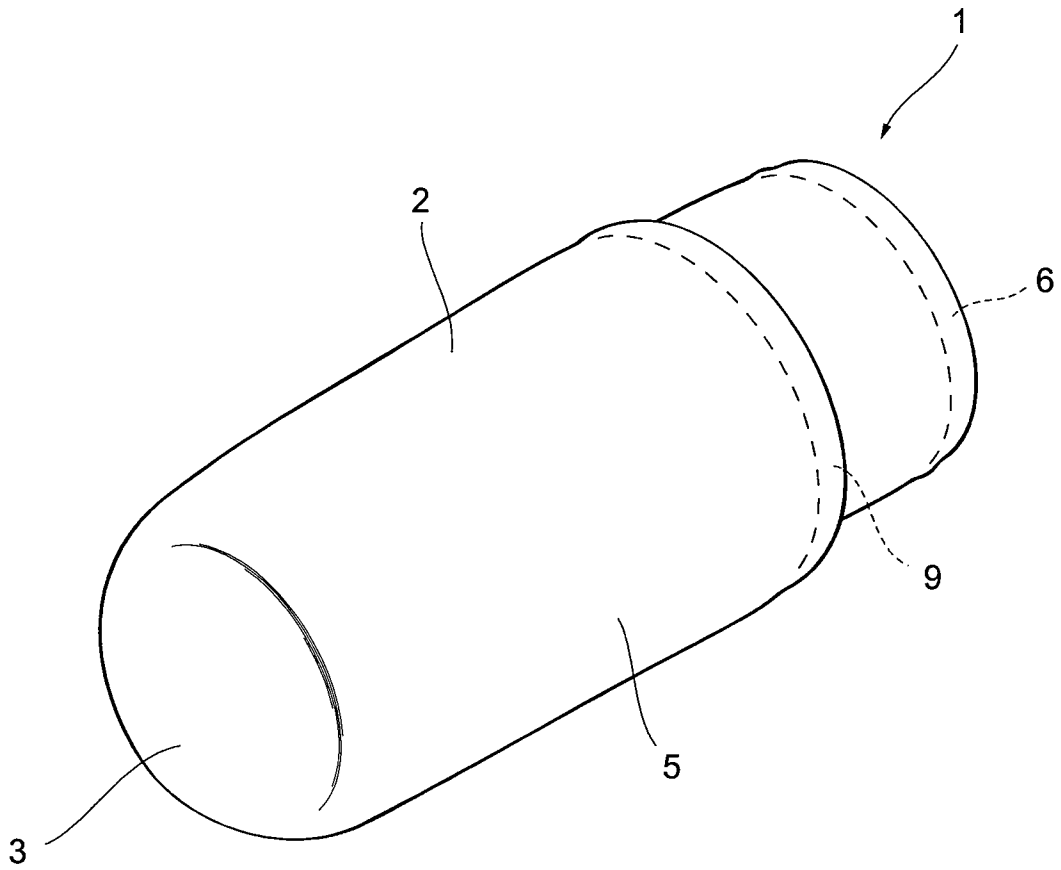
FIG. 2 is a perspective view of the storage bag according to the embodiment as seen from its bottom side.
Figure 3:
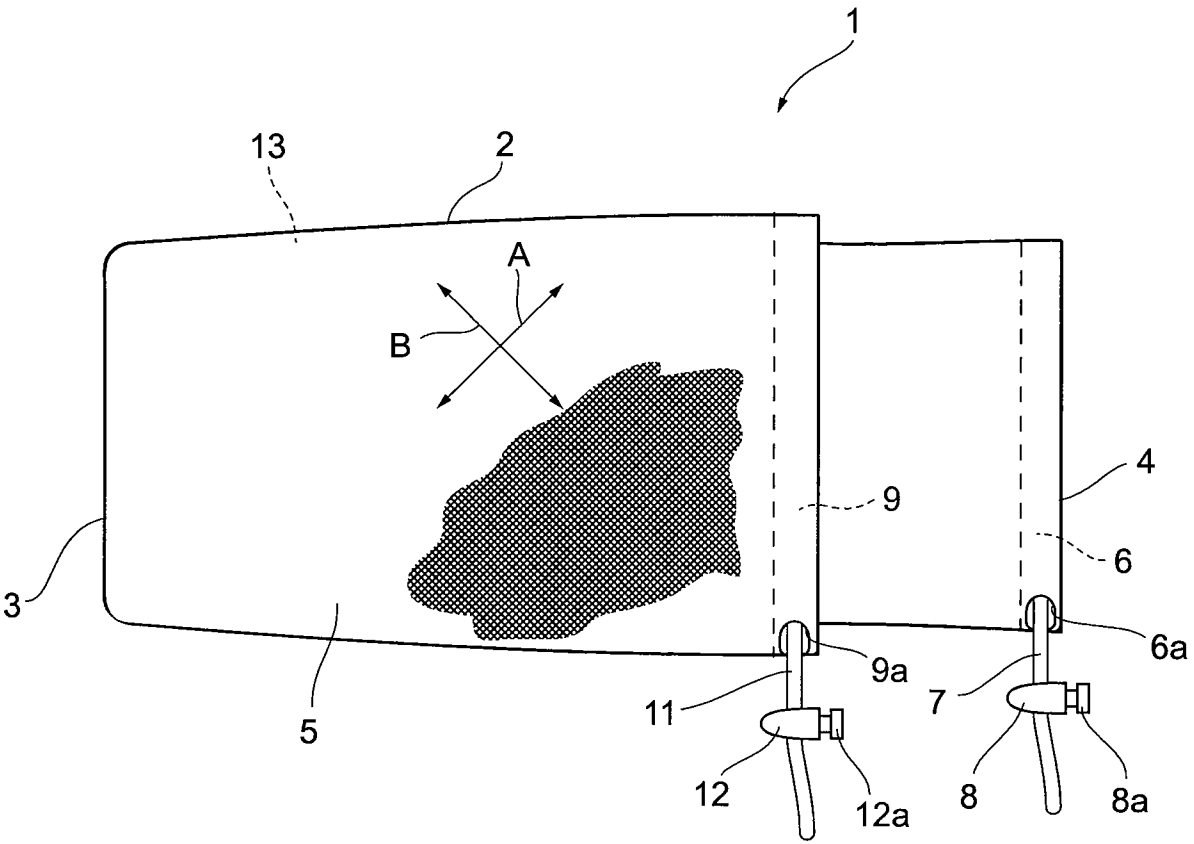
FIG. 3 is a side view of the storage bag according to the embodiment.

FIG. 1 is a perspective view of a storage bag according to an embodiment of the present invention as seen from its storage opening side. FIG. 2 is a perspective view of the storage bag according to the embodiment as seen from its bottom side. FIG. 3 is a side view of the storage bag according to the embodiment.

As shown in FIGS. 1 to 3, this storage bag 1 includes a cylindrical body 2 and a bottom 3 provided at one end of the body 2; and the bottom 3 closes one end of the body 2, thereby forming the inside space of the storage bag as a storage space 13.

The other end of the body 2, opposite the bottom 3, is open and is formed as a storage opening 4 through which an object to be stored is inserted or taken out.

The body 2 is made of generally-rectangular fabric 5 of, for example, synthetic fibers, or natural fibers such as cotton or wool. The body 2 is formed by rolling the rectangular fabric 5 into a cylindrical shape and sewing two ends of the rectangular fabric 5 together. Then, the periphery of a generally-circular bottom 3 made of synthetic fiber fabric is sewed to one end of the body 2, thereby making the bottom 3 close one end of the body 2.

Furthermore, a tunnel-like loop 6 extending along the circumference of the body 2 is formed around the storage opening 4 at the other end of the body 2 by folding the fabric 5 and sewing the folded portion along the circumference of the body 2; and a draw-string 7 is passed through this tunnel-like loop 6. Both ends of this draw-string 7 protrude from an opening 6*a* made at section of the tunnel-like loop 6. A lock member 8 is provided on these protruding portions of the draw-string 7 and the protruding portions of the draw-string 7 are collected at the position where the lock member 8 is located. The lock member 8 has a press portion 8*a* to which force is applied by a force-applying member (not shown in the drawing) to fix the draw-strings 7 in the collected state. With this lock member 8, fixation of the draw-strings 7 is released by pushing down the press portion 8*a* against the force applied by the force-applying member, so that the position of the lock member 8 located on the draw-strings 7 can be changed.

A tunnel-like loop (second tunnel-like loop) 9 extending along the circumference of the body 2 is also formed at a second narrowing position spaced apart for a certain distance from the storage opening 4 of the body 2 towards the bottom 3 side by folding the fabric 5 and sewing the folded portion along the circumference of the body 2; and a draw-string (second draw-string) 11 is also passed through this tunnel-like loop 9. Both ends of this draw-string 11 protrude from an opening 9*a* made at section of the tunnel-like loop 9. A lock member 12 is also provided on these protruding portions of the draw-string 11 and the protruding portions of the draw-string 11 are collected at the position where the lock member 12 is located. The lock member 12 has a press portion 12*a* to which force is applied by a force-applying member (not shown in the drawing) to fix the draw-strings 11 in the collected state. With this lock member 12, fixation of the draw-strings 11 is released by pushing down the press portion 12*a* against the force applied by the force-applying member, so that the position of the lock member 12 located on the draw-strings 11 can be changed.

The fabric 5 constituting the body 2 of the storage bag 1 is made by, for example, weaving 70 denier nylon threads in perpendicular directions; and these fiber directions are set as bias directions.

Specifically speaking, warp and weft fiber directions A and B (see FIG. 3) are inclined with respect to the circumferential direction and the lengthwise direction of the body 2. As a result, the body 2 of the storage bag 1 can stretch or contract in the circumferential direction and the lengthwise direction. Incidentally, the inclination angle is approximately 45 degrees and the expansion/contraction ratio in the circumferential direction is almost the same as that in the lengthwise direction.

The inside diameter of the body 2 becomes gradually larger from the bottom 3 side toward the storage opening 4, so that the diameter of the body 2 on the storage opening 4 side is larger than that on the bottom 3 side.

Figure 4:
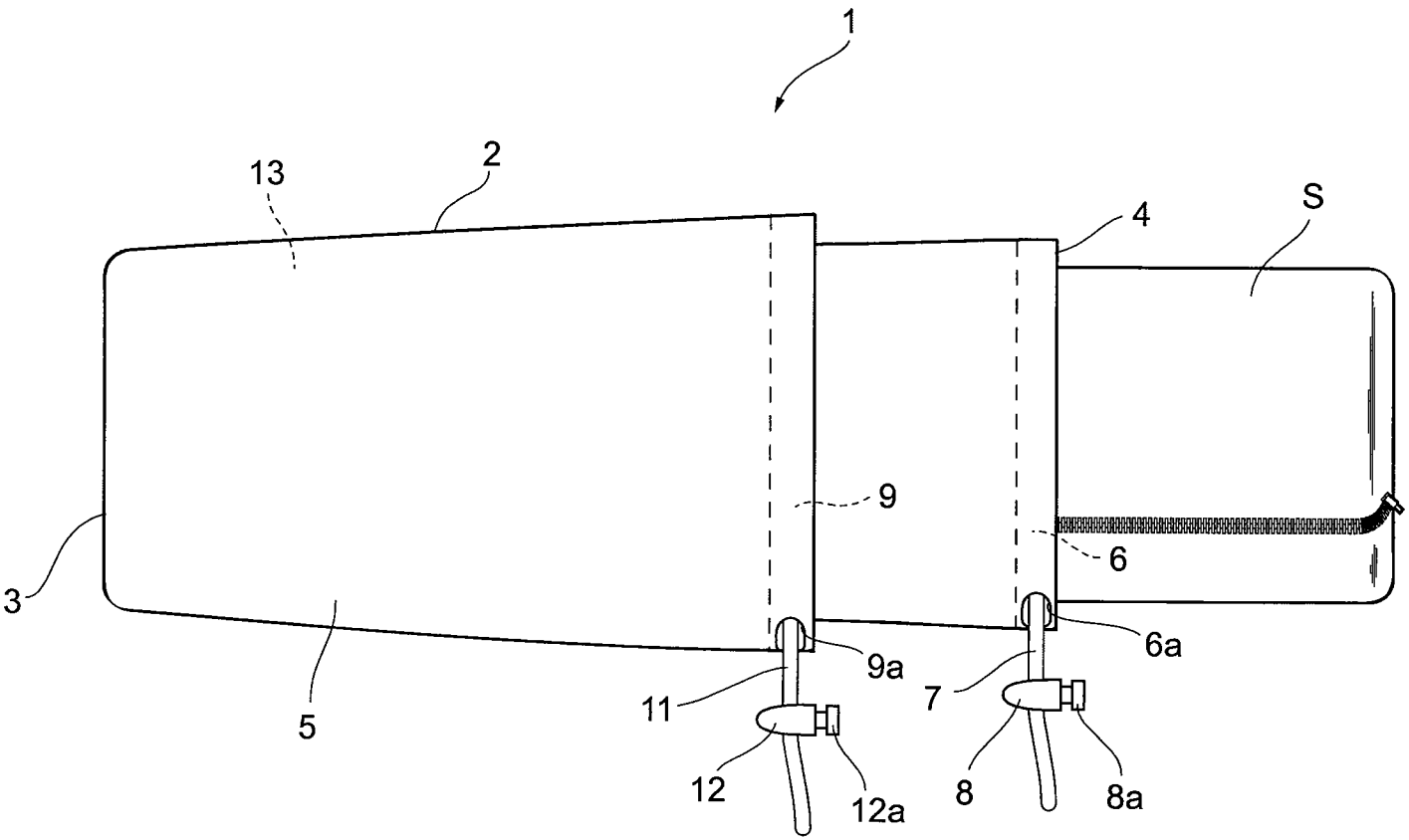
FIG. 4 is a side view showing the state where an object is to be inserted into the storage bag.

Next, the case where an object is inserted into and stored in the storage space 13 of the above-described storage bag 1 will be explained. As shown in FIG. 4, an object S such as a sleeping back or a backpack is rolled up and pushed into the widely-spread storage opening 4 of the storage bag 1.

Since the storage bag 1 is configured so that the inside diameter of the body 2 becomes gradually larger from the bottom 3 side toward the storage opening 4 and the diameter of the storage opening 4 is larger than that of the bottom 3, the object S can be easily inserted into the storage opening 4.

Also, since the diameter of the body 2 becomes gradually larger from the bottom 3 side toward the storage opening 4, when the object S is pushed into the storage space 13, the object S can be smoothly introduced into the storage space 13.

If the object S is pushed further into the storage space 13, the fabric 5 constituting the body 2 stretches in the circumferential direction, so that the storage space 13 expands in the circumferential direction. As a result, even a user who does not have much strength can easily push the object S into the storage space 13.

Figure 5:
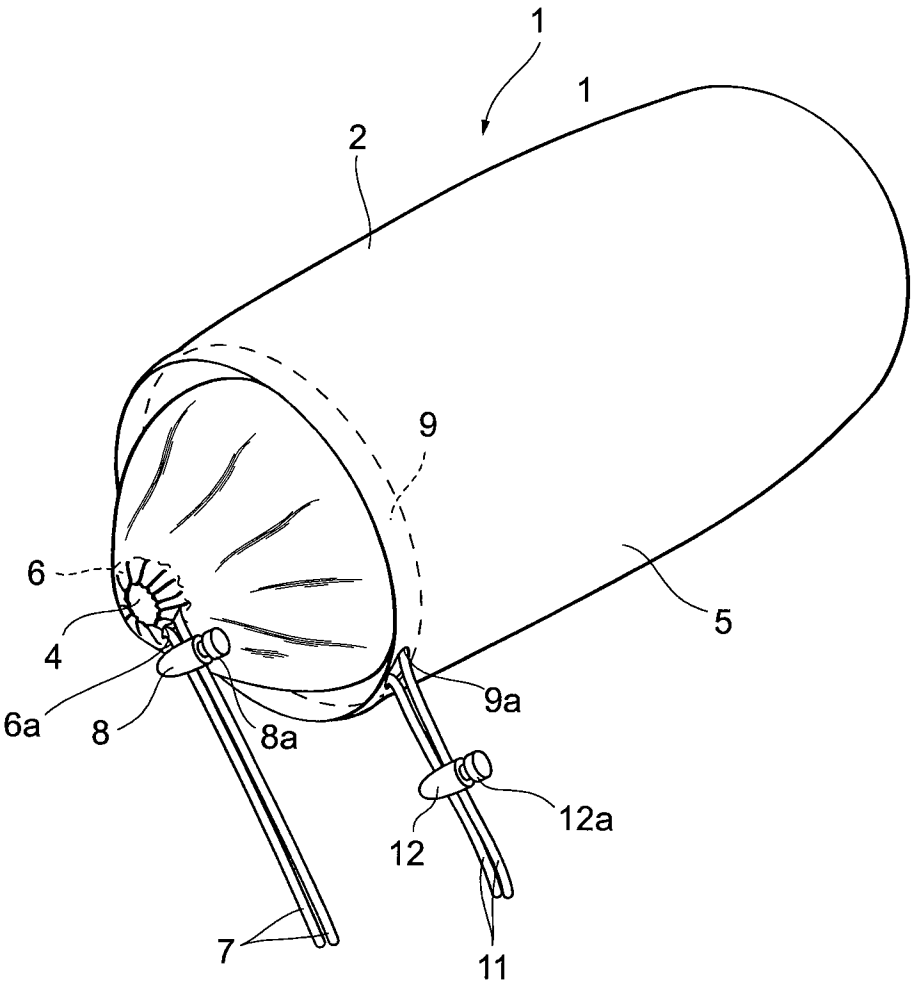
FIG. 5 is a perspective view as seen from the storage opening side showing how the object is stored in the storage bag as seen from the storage opening side.

After the object S is pushed into the storage space 13, the draw-string 7 at the storage opening 4 is pulled. As a result, the storage opening 4 is narrowed by contracting the diameter of the tunnel-like loop 6 portion through which the draw-string 7 passes. With the storage opening 4 narrowed as described above, the press portion 8*a* of the lock member 8 is pushed down to release fixation of the lock member 8 to the draw-string 7; and the ends of the draw-string 7 are pulled through the lock member 8 to move the position of the lock member 8 closer to the opening 6*a* in the tunnel-like loop 6; and then the pressure on the press portion 8*a* is released to fix the draw-string 7. As a result, the tunnel-like loop 6 portion at the storage opening 4 can be kept narrowed by the draw-string 7 as shown in FIG. 5.

Figure 6:
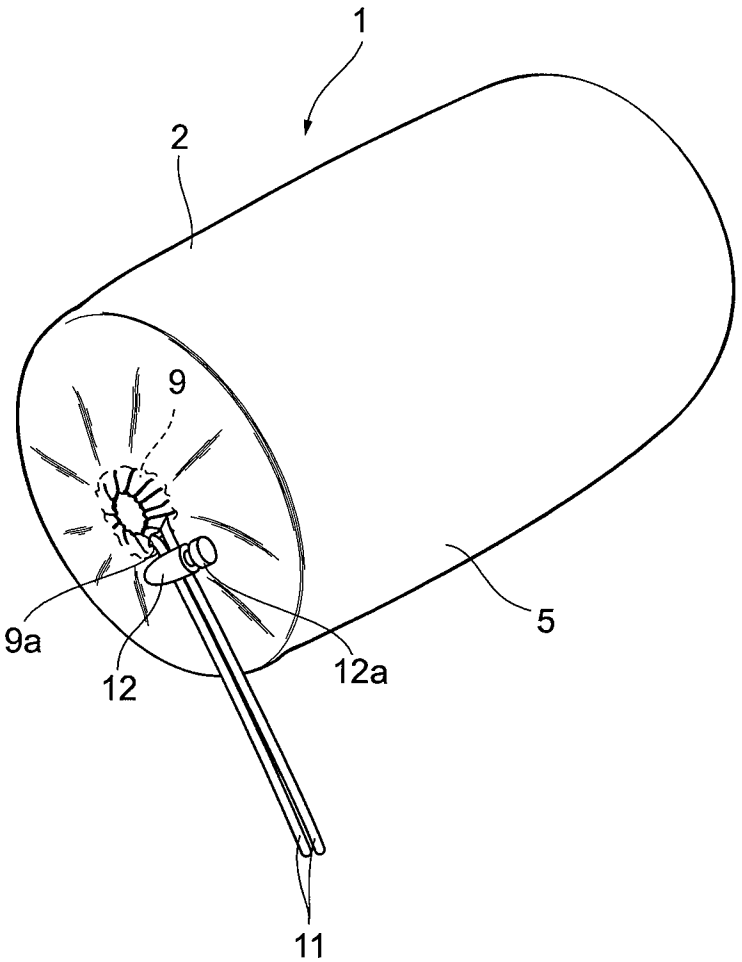
FIG. 6 is a perspective view as seen from the storage opening side showing how the object is stored in the storage bag.

Subsequently, the object S is pushed down further into the storage space 13 and the draw-string 11 near the storage opening 4 is pulled. As a result, the diameter of the tunnel-like loop 9 portion through which the draw-string 11 passes is contracted, thereby narrowing the portion near the storage opening 4. With the portion near the storage opening 4 narrowed by the draw-string 11, the press portion 12*a* of the lock member 12 is pushed down to release fixation of the lock member 12 to the draw-string 11; and the ends of the draw-string 11 are pulled through the lock member 12 to move the position of the lock member 12 closer to the opening 9*a* in the tunnel-like loop 9; and then the pressure on the press portion 12*a* is released to fix the draw-string 11. As a result, the tunnel-like loop 9 portion near the storage opening 4 can be kept narrowed by the draw-string 11 as shown in FIG. 6.

After the object S is pushed into and stored in the storage space 13 as described above, the fabric 5 of the body 2 which has stretched in the circumferential direction contracts due to the restoring force of the fibers such as elasticity of the individual fibers and collective elasticity of the fabric, and the diameter of the storage bag 1 then contracts while the entire storage bag 1 slightly stretches in the lengthwise direction.

Therefore, the storage bag 1 according to the above-described embodiment is configured so that the fiber directions A, B of the fabric 5, in which the fibers are woven in perpendicular directions, are inclined with respect to the circumferential direction and the lengthwise direction of the body 2. As a result, the body 2 can stretch or contract in the circumferential direction and the lengthwise direction.

Consequently, when the object S is to be stored in the storage space 13, it is unnecessary to prepare a large body 2 in advance and the object S can be smoothly inserted into and stored in the storage space 13 because the body 2 expands in the circumferential direction. After the object S is stored in the storage bag 1, the body 2, which has stretched in the circumferential direction, contracts due to the restoring force of the fabric 5. As a result, it is possible to keep the size of the storage bag compact and easily insert the object S into and store it in the storage bag.

Particularly when a normally voluminous and bulky object S such as a sleeping bag or a down jacket is to be stored in the storage bag 1, the object S can be easily inserted into and stored in the storage bag if it is compressed to a certain extent; and, therefore, it is possible to minimize the burden as much as possible on a user who does not have much strength.

Figure 7:
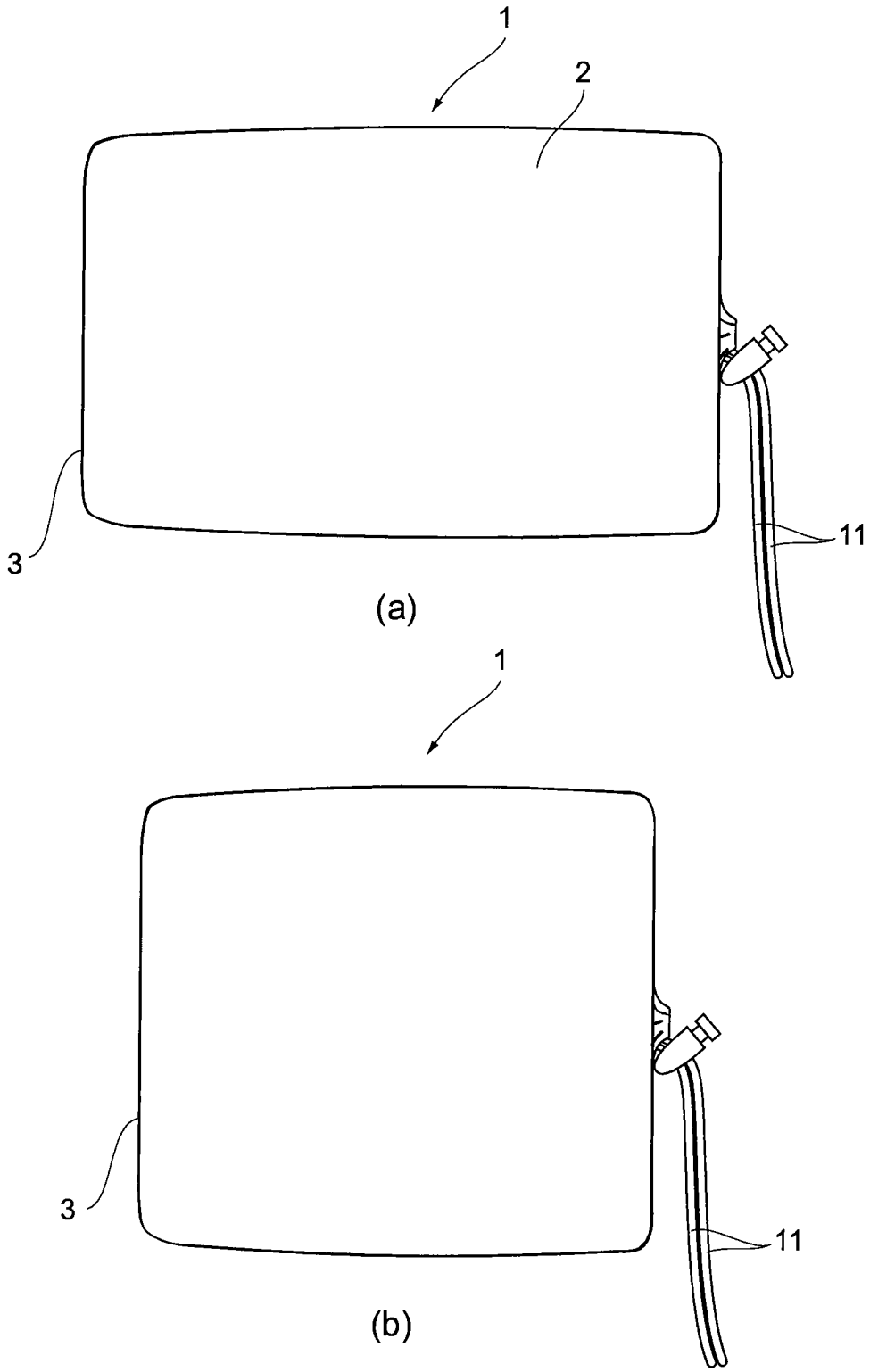
FIGS. 7(*a*) and 7(*b*) are side views of the expanded and contracted state of the storage bag, respectively.

Furthermore, the body 2 stretches or contracts in the radial direction or the lengthwise direction with the object S being stored in the storage bag 1 as shown in FIGS. 7(*a*) and 7(*b*). As a result, the storage bag can be inserted into another bag or backpack by changing the shape of the storage bag 1 in accordance with dead space in that bag or backpack.

Since the body 2 has a large diameter on the storage opening 4 side, the object S can be easily inserted into the storage opening 4, thereby making it much easier to insert the object S into and store it in the storage bag 1.

Also, since the diameter of the body 2 becomes gradually larger from the bottom 3 toward the storage opening 4, when the object S is pushed into the storage space 13, the object S can be smoothly introduced into the storage space 13, thereby making it much easier to insert the object S into and store it in the storage bag 1.

The storage opening 4 can be easily narrowed and closed by pulling the draw-string 7 with the object S stored in the storage space 13.

Furthermore, the storage opening 4 can be closed more tightly by narrowing the portion near the storage opening 4 by pulling the draw-string 11 near the storage opening 4 with the storage opening 4 in the narrowed and closed state.

Incidentally, the above-described embodiment has described the case where the fiber directions A and B of the fabric 5 are inclined at an approximately 45-degree angle to the circumferential direction and the lengthwise direction of the body 2 of the storage bag 1. However, the inclination angle is not limited to 45 degrees and can be set according to the desired expansion/contraction amount and direction(s).

Also, the above-described embodiment has described the case where an object S such as a sleeping bag or a down jacket is stored in the storage bag 1. However, the object S to be stored in the storage bag 1 is not limited to a sleeping bag or a down jacket.

Furthermore, the above-described embodiment has described an example of the storage bag for storing the object S such as a sleeping bag or a down jacket. However, it should be understood that the present invention can be applied to a storage container such as a bag or a backpack. In this case, fiber weave directions of the fabric that forms the body of the bag or backpack are inclined with respect to a direction into which an object is inserted as seen from the front of the bag or backpack ("object insertion direction"), as well as a direction perpendicular to the object insertion direction.

What is claimed is:

1. A storage bag having an inside space formed as a storage space capable of storing an object, the storage bag comprising:

a hollow cylindrical body having a first end and an opposite second end; and a bottom provided at the first end of the body, the bottom closing the first end of the body, the body and the bottom forming the inside space of the storage bag, wherein the second end forms a storage opening, wherein the body has a circumferential direction and a lengthwise direction, and wherein the body is made of fabric with warp and weft fibers interlaced with each other in perpendicular warp and weft directions, wherein the warp and weft directions of the respective warp and weft fibers are both angled at approximately 45 degrees with respect to the circumferential direction and the lengthwise direction of the body, and wherein an expansion-contraction ratio in the circumferential direction is approximately equal to an expansion-contraction ratio in the lengthwise direction such that after expansion of the body of the storage bag in the circumferential and lengthwise directions a restoring force of the fabric contracts the body approximately equally in the circumferential and lengthwise directions.

2. The storage bag according to claim 1, wherein an inside diameter of the body is larger at the second end than at the first end.

3. The storage bag according to claim 2, wherein the inside diameter of the body gradually becomes larger from the first end toward the second end.

4. The storage bag according to claim 1, wherein the bottom of the storage bag is closed.

5. A storage container comprising a body having an open end, wherein the body forms an inside space serving as a storage space, and wherein the open end of the body forms a storage opening, the storage container capable of storing an object by inserting the object into the storage space through the storage opening, wherein the body has a longitudinal direction and a lateral direction, and wherein the body is made of fabric with warp and weft fibers interlaced with each other in perpendicular warp and weft direction such that an expansion-contraction ratio in the longitudinal direction is approximately equal to an expansion-contraction ratio in the lateral direction such that after expansion of the body of the storage container in the longitudinal and lateral directions a restoring force of the fabric contracts the body approximately equally in the longitudinal and lateral directions, wherein a first tunnel-like loop extends along a first circumference of the body forming the storage opening, a section of the first tunnel-like loop including an opening, wherein a first draw-string passes through the first tunnel-like loop and includes a string portion that protrudes from the opening at the section of the first tunnel-like loop, wherein the storage opening is narrowed and closed by pulling the string portion of the first draw-string protruding from the opening of the first tunnel-like loop, wherein a second tunnel-like loop extends along a second circumference of the body at a narrowing position that is between the open end and an opposite end, a section of the second tunnel-like loop including an opening, wherein a second draw-string passes through the second tunnel-like loop and includes a string portion that protrudes from the opening at the section of the second tunnel-like loop, wherein the body at the narrowing position is narrowed by pulling the string portion of the second draw-string protruding from the opening of the second tunnel-like loop, wherein the first and second tunnel-like loops with first and second draw-strings are located closer to the storage opening than the opposite end of the storage container, wherein the second circumference of the body at the narrowing position is greater than the first circumference of the body at the storage opening, and wherein a portion of the body from the narrowing position to the storage opening is collapsible within the body such that the portion is enclosed within the body when the second draw-string is in a closed state.

6. The storage container according to claim 5, wherein the body also has a closed end opposite the open end.

* * * * *

UNITED STATES PATENT AND TRADEMARK OFFICE

CERTIFICATE OF CORRECTION

PATENT NO. : 8,801,286 B2
APPLICATION NO. : 12/371093
DATED : August 12, 2014
INVENTOR(S) : Isamu Tatsuno It is certified that error appears in the above-identified patent and that said Letters Patent is hereby corrected as shown below:

In the Claims

Column 7, line 10 (Claim 5): “direction” should be --directions--.

Signed and Sealed this
Tenth Day of February, 2015

Michelle K. Lee

Michelle K. Lee
*Deputy Director of the United States Patent and Trademark Office*